United States Patent [19]

Stephens et al.

[11] 4,175,293

[45] Nov. 27, 1979

[54] TOILET BOWL ODOR REMOVING APPARATUS AND HINGE

[76] Inventors: Warren J. Stephens, 2970 S. 1735 East, Salt Lake City, Utah 84106; Juan F. Nielson, 3665 S. 300 West, Salt Lake City, Utah 84115

[21] Appl. No.: 875,215

[22] Filed: Feb. 6, 1978

[51] Int. Cl.[2] ..... E03D 9/05; A47K 13/00

[52] U.S. Cl. ..... 4/209 R; 4/213; 4/217; 4/348

[58] Field of Search ..... 4/207, 213, 216, 217, 4/211, 136, 140, 210, 347, 348

[56] References Cited

U.S. PATENT DOCUMENTS

| | | | |
|---|---|---|---|
| 771,254 | 10/1904 | Kendrick | 4/217 |
| 854,365 | 5/1907 | Lueckenbach | 4/217 |
| 1,173,520 | 2/1916 | Hunter | 4/217 |
| 2,527,110 | 10/1950 | Wheeler | 4/217 |
| 2,743,462 | 5/1956 | McMillan | 4/213 |
| 3,003,157 | 10/1961 | Belcher | 4/217 |
| 3,357,029 | 12/1967 | Schulz | 4/217 |
| 3,416,167 | 12/1968 | Klemme | 4/217 |
| 3,533,112 | 10/1970 | Poister | 4/217 |
| 3,824,637 | 7/1974 | Hunnicutt, Jr. | 4/213 |
| 3,887,949 | 6/1975 | Osmond | 4/216 X |
| 3,916,459 | 11/1975 | Ivanceric | 4/217 X |
| 4,071,915 | 2/1978 | Kurataro | 4/217 |
| 4,085,470 | 4/1978 | Roberts | 4/217 |

*Primary Examiner*—Stuart S. Levy

[57] ABSTRACT

Apparatus for removing odors from the bowls of conventional toilets inclues a hood adapted to be mounted to a toilet body, to overhang the toilet bowl and having a central plugged opening at the rear thereof; tubular spindles adapted to be coupled into opposite sides of the hood; a toilet seat pivotally mounted on the spindles; and plugs and a vent duct adapter that may be selectively connected to the tubular spindles and the central plugged opening. A suction fan disposed inside a wall adjacent the toilet is coupled to a duct for removing gases collected by the hood from within the toilet bowl.

1 Claim, 5 Drawing Figures

TOILET BOWL ODOR REMOVING APPARATUS AND HINGE

BRIEF DESCRIPTION OF THE INVENTION

1. Field of the Invention

This invention relates to apparatus adapted for use with conventional toilets for removing odors from toilet bowls.

2. Prior Art

Systems for removing odors from bathrooms have been in use for many years. Such systems typically provide for a vent located in the ceiling or high on the wall of the bathroom with a fan located above the vent and operable to withdraw air from the entire bathroom. The drawback with this type of system is that the odor removing equipment is not positioned close to the source of the odor, namely the toilet bowl. Thus, a good deal of air must be exhausted from the bathroom to ensure removal of odors.

One arrangement for locating odor removing equipment closer to the source of the odor is disclosed in U.S. Pat. No. 2,743,462. Here, the odor removing equipment includes a tubular hinge assembly for the seat. In this device although the odor removing apparatus is at times positioned close to the toilet bowl and thus the source of the odor, the odor removing apparatus is pivotable with the toilet seat and does not always remain in position to collect odors. The toilet seat must cooperate with the hinge assembly to provide an odor removal passageway.

Two other arrangements are disclosed in U.S. Pat. Nos. 3,849,808 and 3,824,637. In both of these arrangements, fixed odor collecting manifolds are provided, but these extend behind the toilet and cannot always be used in close quarters, particularly as found in camp trailers and vehicles, etc.

SUMMARY OF THE INVENTION

It is an object of the present invention to provide a simple, versatile, inexpensive and easy to manufacture and to install toilet bowl odor removing apparatus.

It is still another object of the present invention to provide toilet bowl odor removing apparatus which is located and remains at all times near the toilet bowl, and thus the source of the odor.

Other objects are to provide odor removing apparatus that includes a minimum number of components all of which are easily accessible for cleaning and that can be rearranged to accommodate different toilet and toilet room structures.

The above and other objects of the present invention are realized in a specific illustrative embodiment which includes a hood adapted to be coupled to a toilet and to extend over the toilet bowl and hollow spindles that provide pivot axes for a toilet seat and cover. Venting is accomplished through the hood and a port opening thereinto or through a hollow spindle.

The above and other objects, features and advantages of the present invention will become apparent from a consideration of the following detailed description presented in connection with the accompanying drawings.

THE DRAWING

In the drawing:

FIG. 1 is a perspective view of toilet bowl odor removing apparatus mounted on a toilet and made in accordance with the principles of the present invention with the toilet seat and lid lowered;

FIG. 2, a fragmentary perspective view with the lid and seat (shown fragmentarily) in raised position and with other parts exploded for clarity;

FIG. 3, an enlarged perspective view of the assembled hood, toilet seat and lid, shown fragmentarily;

FIG. 4, a vertical section view taken on the line 4—4 of FIG. 3; and

FIG. 5, a vertical section view taken on the line 5—5 of FIG. 3.

DETAILED DESCRIPTION

Figure 1:
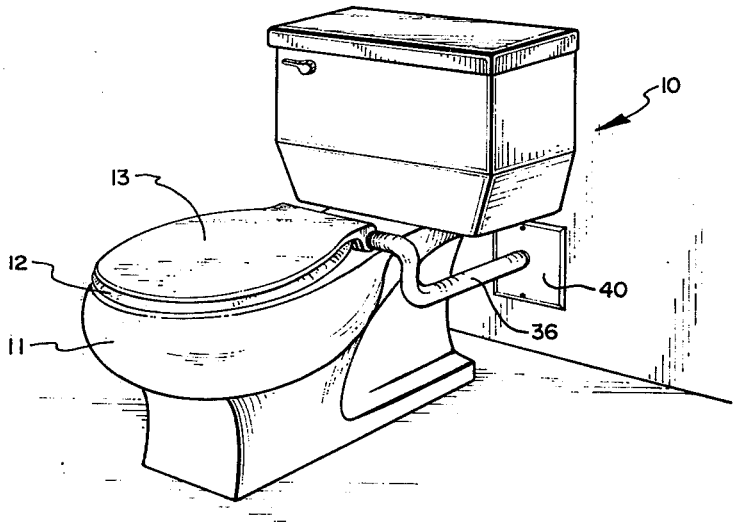
Figure 2:
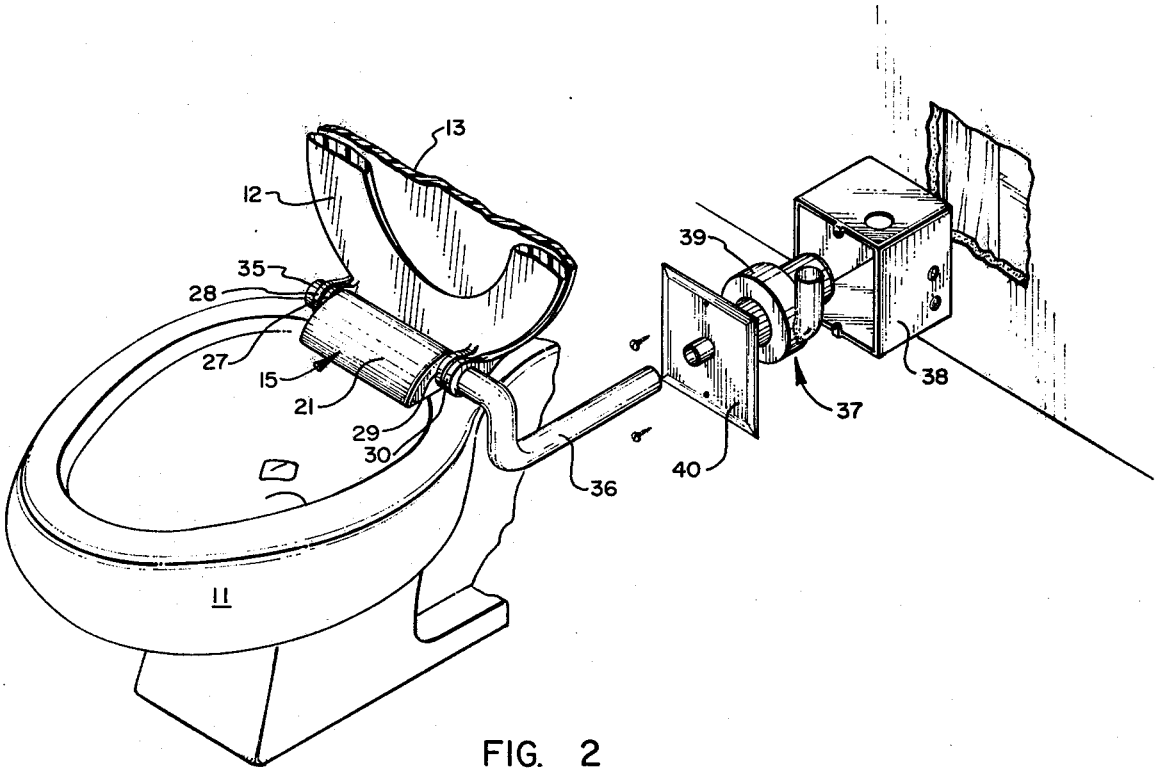

Referring now to the drawing:

In FIG. 1, there is a conventional toilet shown generally at 10, having a toilet bowl 11, and a toilet seat 12 and toilet seat lid 13 mounted on the toilet bowl.

Figure 3:
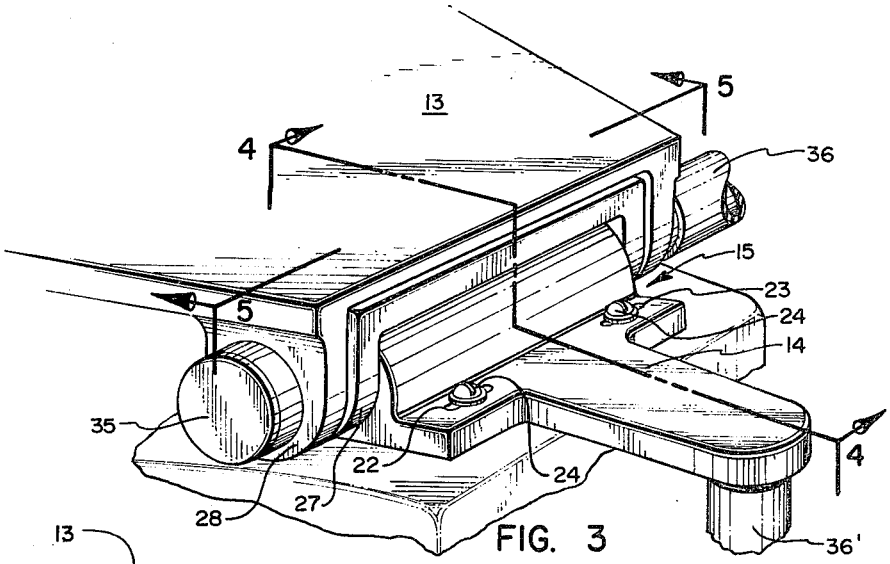
Figure 4:
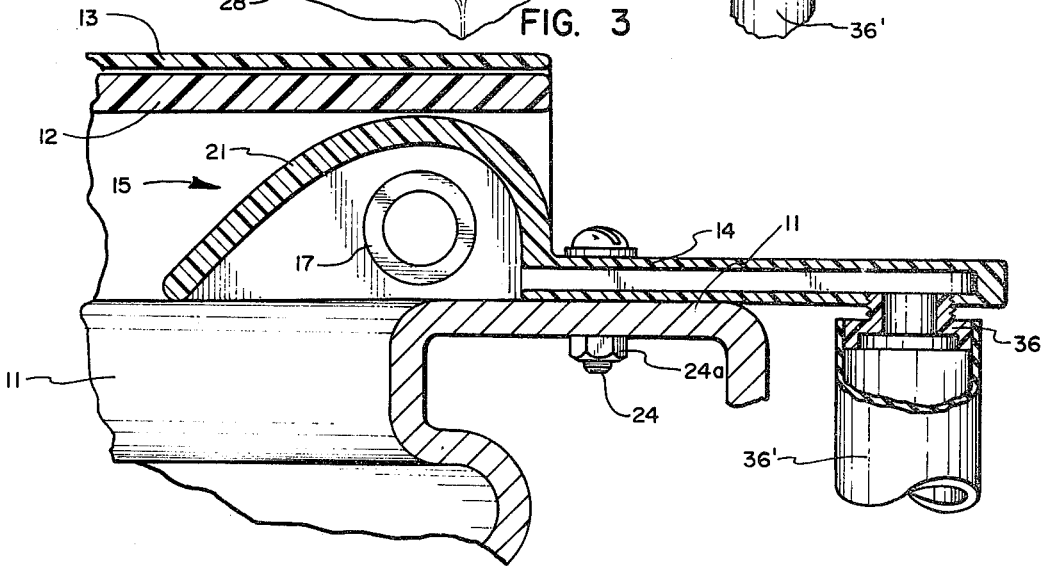

The apparatus of the present invention is constructed so that it may be attached to a conventional toilet such as that shown at 10 in the drawings. This is accomplished by rigidly mounting a generally flat flange 14 (FIG. 3) of a hood 15 to the rear of the upper rim of the toilet bowl 11 and pivotally mounting the toilet seat and toilet lid to hollow spindles 16 and 17 coupled into the hood.

Figure 5:
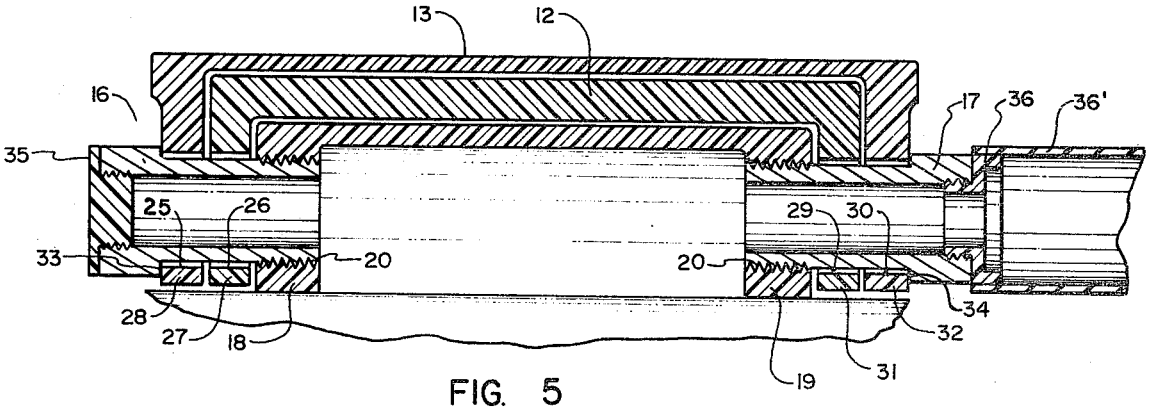

The hood 15 has spaced apart sidewalls 18 and 19 (FIG. 5), each having a threaded port 20 therethrough and into which the spindles 16 and 17 are threaded. A curved upper wall 21 extends upwardly, outwardly and down from the flange 14 and interconnects the sidewalls 18 and 19. Holes 22 and 23 through the flange 14 align with holes in the rear of the toilet 10 and the hood 15 is rigidly mounted to the toilet by bolts 24 passed through the aligned holes and nuts **24*a*** threaded onto the bolts.

Spindle 16 is inserted through holes 25 and 26 provided therefor in ears 27 and 28 that respectively project from the seat 12 and lid 13 and is threaded into a port 20. Similarly, the spindle 17 is inserted through holes 29 and 30 provided therefor in ears 31 and 32 that respectively project from the seat 12 and lid 13, and is threaded into the other port 20.

Shoulders 33 and 34 on the spindles 16 and 17, respectively, and the sidewalls 18 and 19 hold the seat 12 and lid 13 in place, while allowing them to freely pivot about the spindles 16 and 17.

The spindles 16 and 17 project beyond the ears 28 and 32 of the lid 13 and a plug 35 may be threaded into the projecting end of one spindle (here shown as spindle 16) while a duct fitting 36 may be threaded into the projecting end of the other spindle. It will be apparent that the plug and duct fitting could easily be reversed, with respect to the spindles or that the positions of the spindles themselves could be reversed. This flexibility in positioning increases the options available to an installer of the apparatus and allows the duct fitting 36 to be positioned such that oderous air can be passed through the duct connected thereto, but in the most unobtrusive manner possible and to either side of the toilet.

It will be noted that with the apparatus thus far described, all components, including the lid, seat and tubular spindles are positioned forwardly, i.e. towards the front of the toilet, from the flange 14 of hood 15, so that the apparatus can be conveniently used on any standard toilet, even though such toilet may be suspended from a wall or positioned closely to the wall.

Duct 36 communicates with the interior of the spindle 17 so that a continuous passageway is defined from the interior of hood 15 through the spindle 17, and duct 36 to the suction device 37.

All components of the apparatus may advantageously be fabricated from suitable plastic materials and the toilet seat 12 is molded such that when assembled it will rest on the rim of the toilet bowl. The toilet seat lid 13 is shaped to rest on and to cover the usual opening through the toilet seat.

In operation, the suction device 37, composed, for example, of a motor driven squirrel-cage fan 39 mounted on a housing 38 within the wall or ceiling of a bathroom and hidden by a cover plate 40, operates to withdraw gases from the interior of the toilet through the hood 15, duct fitting 36 and a duct 36'. The outlet of the suction device may discharge into the wall or attic or may be coupled to an exhaust duct that will carry the gases outside of the building.

The hood 15 also has a threaded port 41 formed centrally through a rear wall thereof. A plug, similar to the plug 35, previously described, may be used to close the port when venting is through a hollow spindle, or the plug may be used to cap a hollow spindle and the duct fitting 36 may be threaded into port 41.

The port 41 allows the odor removing apparatus of the invention to be used in an even larger variety of situations. Not only can the duct be attached to the spindles at either side of the toilet, but, if desired, it can be attached to extend directly to the rear of the toilet. Such an arrangement is often necessary, for example in recreation vehicles, where available space for mounting such a unit is very limited.

Although preferred forms of my invention have been herein disclosed, it is to be understood that the present disclosure is made by way of example and that variations are possible without departing from the scope of the hereinafter claimed subject matter, which subject matter I regard as my invention.

We claim:

1. Odor removing apparatus for use with a conventional toilet comprising a hood including a rearwardly extended flat flange forming a collection compartment extending fully across the hood, said flange being adapted to be coupled to the rear portion of the rim of a toilet, a pair of spaced apart sidewalls extending forwardly of the flange, and a top wall interconnecting said sidewalls, whereby the sidewalls and top wall will project over the toilet bowl when the flange is coupled to the rear portion of the rim of the toilet;

a pair of tubular spindles, each of said spindles being coupled through an end wall of the hood;

a toilet seat having spaced apart projecting ears journaled on said spindles and a straight rear edge overlying the rim of the toilet and the hood, with a top of the rearwardly extending flat flange being positioned whereby such flange does not obstruct pivoting movement of the toilet seat;

a toilet seat lid having a spaced apart projecting ears journaled on said spindles outside of the ears of the toilet seat and adapted to rest on the toilet seat;

a plug closing the projecting end of one spindle;

a duct fitting coupled to the projecting end of the other spindle and its other end adapted to be connected by a duct to a suction means whereby gases are pulled from the interior of the hood, through a spindle, the duct fitting and the duct to the intake of the suction means, said plug and the duct fitting being reversible with respect to the spindles;

the sidewalls each have a threaded port therethrough and the spindles are exteriorly threaded to be screwed into ports;

a port through the wall at the central rear thereof, said port being adapted to receive either said plug or said duct fitting; and another plug adapted to close either of said spindles or the port through the wall of the hood.

* * * * *